US005110714A

United States Patent [19]

Furusawa et al.

[11] Patent Number: 5,110,714

[45] Date of Patent: * May 5, 1992

[54] METHOD FOR PROCESSING SILVER HALIDE COLOR PHOTOGRAPHIC MATERIAL

[75] Inventors: Genichi Furusawa; Yasuhiro Yoshioka; Yasufumi Nakai, all of Minami-ashigara, Japan

[73] Assignee: Fuji Photo Film Co., Ltd., Kanagawa, Japan

[ * ] Notice: The portion of the term of this patent subsequent to Apr. 2, 2008 has been disclaimed.

[21] Appl. No.: 416,801

[22] Filed: Oct. 3, 1989

[30] Foreign Application Priority Data

Oct. 3, 1988 [JP] Japan ..... 63-249243

[51] Int. Cl.[5] ..... G03C 7/46; G03C 7/30

[52] U.S. Cl. ..... 430/376; 430/380; 430/382; 430/383; 430/467; 430/505; 430/963

[58] Field of Search ..... 430/505, 382, 383, 380, 430/963, 376, 467, 476

[56] References Cited

U.S. PATENT DOCUMENTS

| | | | |
|---|---|---|---|
| 4,789,624 | 12/1988 | Sakanoue et al. | 430/372 |
| 4,828,970 | 9/1989 | Kuse et al. | 430/393 |
| 4,853,321 | 8/1989 | Momoki et al. | 430/380 |
| 4,880,728 | 11/1989 | Ishikawa et al. | 430/380 |

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

There is disclosed a method for processing a silver halide color photographic material with a color developer containing at least one aromatic primary amine color-developing agent. In the method a silver halide color photographic material having at least one of the layers of which comprises a silver halide emulsion of high chloride containing 80 mol % or over of silver chloride, and containing at least one coupler having relative coupling rate of 0.05 or over in each color-sensitive layer is processed, after exposure to light, with a color developer containing a specified amount of chloride ions and bromide ions.

12 Claims, No Drawings

METHOD FOR PROCESSING SILVER HALIDE COLOR PHOTOGRAPHIC MATERIAL

FIELD OF THE INVENTION

The present invention relates to a method for processing a silver halide color photographic material, and more particularly a development processing method that uses a silver halide color photographic material having a high silver chloride content, which is excellent in development characteristics.

BACKGROUND OF THE INVENTION

In recent years in the photographic processing of color photographic materials, with the shortening of the time of delivery of finished goods and the reduction of labor in laboratories, it is desired to shorten the processing time. To accomplish this, while generally the temperature or the replenishing amount is increased, other various techniques have also been proposed, such as the intensification of stirring or the addition of various accelerators.

Among others, for the purpose of making the color development rapid and/or of reducing the replenishing amount, it is known to use a method wherein a color photographic material containing a silver chloride emulsion, instead of the conventionally widely used silver bromide type emulsions or silver iodide emulsions, is processed. For example, in International Publication No. WO-87-04534, a method is described for rapidly processing a high-silver-chloride color photographic material with a color developer substantially free from sulfite ions and benzyl alcohol.

However, it has been found that when development processing is carried out by an automatic processor for papers according to the above method, streaked fogging occurs. This is assumed to occur as follows: when the photographic material comes in contact with a roller or the like in the developing tank of an automatic processor, the photographic material becomes scarred and is pressure-sensitized, resulting in streaked fogging due to the pressure sensitization, that is, so-called in-solution pressure-sensitized streaks occur. Further, facts have been apparent that when the method is used for continuous processing, the fluctuation of photographic quality, in particular the fluctuation of sensitivities of cyan, magenta, and yellow becomes conspicuous, and insufficient desilvering takes place such that the white background is greatly stained.

Thus, rapid development processing that uses a high-silver-chloride color photographic material is accompanied by such serious problems as in-solution pressure-sensitized streak fogging, fluctuation of the photographic quality, and the occurrence of insufficient desilvering, and therefore such processing could not be practically used.

Further, in a rapid process that uses a high-silver-chloride color photographic material, in order to reduce the fluctuation of photographic quality, in particular the fluctuation of minimum density (Dmin), involved in continuous processing, the use of organic antifogging is known, as described in JP-A ("JP-A" means unexamined published Japanese patent application) Nos. 95345/1983 and 23342/1984. However, it has been found that the use of the organic antifoggants prevents neither the occurrence of pressure-sensitized streaks-fogging, as mentioned above, nor the increase of Dmin involved in continuous processing, and it has also been found that the occurrence of insufficient desilvering involved in continuous processing further increases.

JP-A No. 70552/1986 describes a process for lowering the replenishing amount of a developer, wherein a high-silver-chloride color photographic material is used and a replensisher is added in such an amount that overflow to the developing bath will not take place during the development processing, while JP-A No. 106655/1988 describes a process for processing a high-silver-chloride color photographic material with a color developer containing a hydroxylamine compound and a chloride, in a certain concentration or over, to stabilize the processing. However, it was also found that these methods could not be used in practice because of the occurrence of in-solution pressure-sensitized streak fogging in the process using an automatic processor, as mentioned above, and the occurrence of defective photographic sensitivity and insufficient desilvering in continuous processing were recognized even in these methods.

BRIEF SUMMARY OF THE INVENTION

Therefore, the first object of the present invention is to provide a method for rapid development processing that can prevent in-solution pressure-sensitized streak fogging.

The second object of the present invention is to provide a method for development processing that will result in excellent photographic characteristics low in Dmin and high in Dmax, and that can suppress remarkably the fluctuation of photographic characteristics, particularly the fluctuation of sensitivity, in continuos processing.

The third object of the present invention is to provide a method for development processing that will result in a smaller amount of silver remaining after processing, and that is improved in bleach ability.

The above and other objects, features, and advantages of the invention will become apparent in the following detailed description.

DETAILED DESCRIPTION OF THE INVENTION

The objects of the present invention have been accomplished by a method for processing a silver halide color photographic material with a color developer containing at least one aromatic primary amine color-developing agent, characterized in that a silver halide color photographic material having at least one layer comprising a high-silver-chloride silver halide emulsion containing 80 mol% or more of silver chloride, and containing at least one coupler whose relative coupling rate is 0.05 or over in each of the red-sensitive layer, the green-sensitive layer, and the blue-sensitive layer, is processed with a color developer containing $3.5\times10^{-2}$to $1.5\times10^{-1}$ mol of chloride ions/l and $3.0\times10^{-5}$ to $1.0\times10^{-3}$ mol of bromide ions/l.

In this specification and claims the term "coupler" means cyan couplers, magenta couplers, and yellow couplers that contribute directly to the formation of cyan, magenta, and yellow dye images.

Although it is well known that chloride ions are an antifoggant, the effect is low, and the use of a large amount of chloride ions would result in neither complete prevention of the increase in fogging in continuous processing nor complete prevention of the streak fogging that will occur in a process using an automatic processor, but disadvantageously it would make the development slow and would lower the maximum density.

Further, although it is well known that bromide ions are an antifoggant, bromide ions could not be used practically, because when bromide ions were used alone, although fogging involved in continuous processing and streaked pressure marks could be prevented, the development was suppressed and the maximum density and the sensitivity were lowered.

However, the present inventors have studied in various ways and found that when a high-silver-chloride photographic material having a silver chloride content of 80 mol% or over and containing a coupler whose relative coupling rate is 0.05 or over in each of the red-sensitive layer, the green-sensitive layer, and the blue-sensitive layer is processed with a color developer containing $3.5\times10^{-2}$ to $1.5\times10^{-1}$ mol of chloride ions/l and $3.0\times10^{-5}$ to $1.0\times10^{-3}$ mol of bromide ions/l, the maximum density becomes high, the fogging of streaked pressure marks that occur in processing using an automatic processor, and the fluctuation of photographic quality (particularly the fluctuation of cyan sensitivity, magenta sensitivity, and yellow sensitivity) involved in continuous processing can be further prevented, and in addition the amount of residual silver can be reduced remarkably. These facts are unexpected and are surprising. In particular, it is surprising that the fluctuation of sensitivity in continuous processing can be suppressed by controlling the relative coupling rate.

Although details of the mechanism for preventing the fogging of streaked pressure marks in processing using an automatic processor are not clear, they can be presumed as follows. It is considered that, after exposure to light, when the photographic material undergoes excessive pressure in a color developer, the pressurized part becomes intensified and forms fog nuclei, thereby forming fogging. However, it is assumed that since the developer of the present invention contains suitable amounts of bromide ions and chloride ions, development of fog nuclei only is suppressed, but the development of latent image nuclei is not suppressed, so that fogging can be prevented without delaying development and without lowering the maximum density and the sensitivity.

Further, it is considered that the effect for preventing photographic quality from fluctuating in continuous processing depends, for example, on stabilization of development performance against the fluctuation of the developing agent, the preservative of the developing agent, and the pH of the developer due to the presence of suitable amounts of bromide ions and chloride ions.

Further, the detailed mechanism for remarkably suppressing insufficient desilvering is inferred as follows. Since the cause of insufficient desilvering is the use of a high-silver-chloride photographic material, it is presumed that silver sulfide is liable to be formed, because the amount of bromide ions present around developed silver is small, thereby leading to insufficient desilvering. For example, the facts that suitable amounts of bromide ions and chloride ions contained in the developing solution suppress that formation of silver sulfide are presumed to be related to the suppression of insufficient desilvering.

Now the present invention will be described in more detail.

The term "relative coupling rate" used in this specification and claims is the value represented by X:

$$X = \frac{1}{\frac{\tan A}{\tan B} - 1}$$

wherein tan A is the gradient of the linear section of the Dye/Ag° obtained by using a color developer A described below, and tan B is the gradient of the linear section of the Dye/Ag° obtained by using a color developer B described below, in which the relationship Dye/Ag° between the amount of developed silver "Ag" and the amount of the formed dye "Dye" can be found by using a single layer coated sample given below and the color developers (A and B), and by subjecting the sample to the processing steps given below.

The term "relative coupling rate" used herein is different from the term "relative coupling rate" described in JP-A Nos. 72239/1986, 11635/1986, 118753/1986, and 189536/1986, etc.

Method for determining "relative coupling rate"

Single layer coated sample

| | |
|---|---|
| Base: Polyethylene terephthalate | |
| First layer | |
| Silver chlorobromide emulsion (silver bromide: 70 mol %) (in terms of silver) | 8 mmol/m$^2$ |
| Coupler | 1 mmol/m$^2$ |
| Trioctyl phosphate (weight ratio to coupler) | 1:1 |
| Gelatin | 4 g/m$^2$ |
| Hardener (1-hydroxy-3,5-dichloro-s-triazine sodium salt) | 3.2 mg/m$^2$ |
| Sosium dodecylbenzenesulfonate | 0.08 g/m$^2$ |
| Second layer | |
| Gelatin | 1 g/m$^2$ |
| Hardener (1-hydroxy-3,5-dichloro-s-triazine sodium salt) | 0.8 mg/m$^2$ |

| Color developers | A | B |
|---|---|---|
| Water | 800 ml | 800 ml |
| Potassium bromide | 0.6 g | 0.6 g |
| Sodium hydrogencarbonate | 0.7 g | 0.7 g |
| Potassium carbonate | 31.7 g | 31.7 g |
| Sodium sulfite | 0.3 g | 0.3 g |
| N-ethyl-N-(β-methanesulfonamido-ethyl)-3-methyl-4-aminoaniline sulfate | 4.5 g | 4.5 g |
| Citrazinic acid | — | $1\times10^{-2}$ mol |
| Water to make | 1000 ml | 1000 ml |
| pH (25° C.) | 10.25 | 10.25 |

Stop solution 1 wt. % aqueous acetic acid solution

As the fixing solution and bleaching solution, commercially available ones can be used. The test for evaluation can be carried out, for example, by using Bleaching Solution $N_2$ and Fixing Solution $N_3$ of Color Negative Film Processing Agent CN-16. Herein, even if the fixing solution and the bleaching solution are different in formulation, essentially they will not influence the "relative coupling rate" mentioned above.

Processing steps

Color-development bath (33° C., 3 min 30 sec)
↓
Stop bath (33° C., 1 min)
↓
Fixing bath (33° C., 5 min)
↓
Washing (25 to 35° C., 3 min)

-continued

↓
Drying
↓
Measurement of the amount of silver (fluorescent X-ray)
↓
Bleaching bath (38° C., 6 min)
↓
Fixing bath (38° C., 4 min)
↓
Washing
↓
Drying
↓
Measurement of density (Densitometer FCD-103.

-continued manufactured by Fuju Photo Film Co., Ltd.)

Procedure

Two pieces of each sample were exposed to light stepwise and processed in the steps mentioned above using the color developers A and B, to obtain the Dye-/Ag°, respectively.

Relative coupling rates of the representative couplers in this invention measured according to the present method are shown below.

| Coupler | Coupling Rate |
|---|---|
| 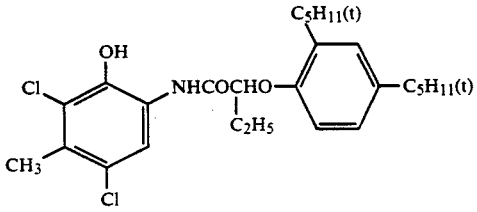 | 0.15 |
| 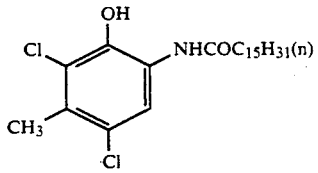 | 0.32 |
| 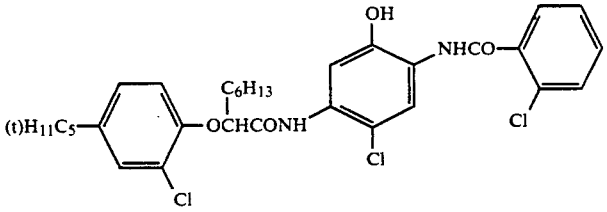 | 0.10 |
| 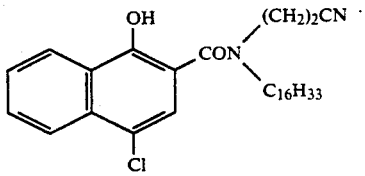 | 0.26 |
| 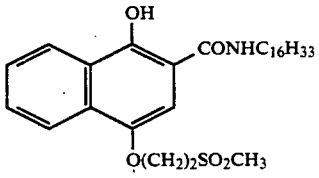 | 0.86 |
| 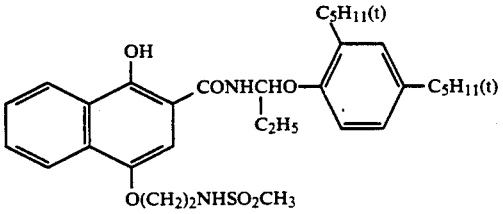 | 0.71 |

-continued
| Coupler | Coupling Rate |
|---|---|
| 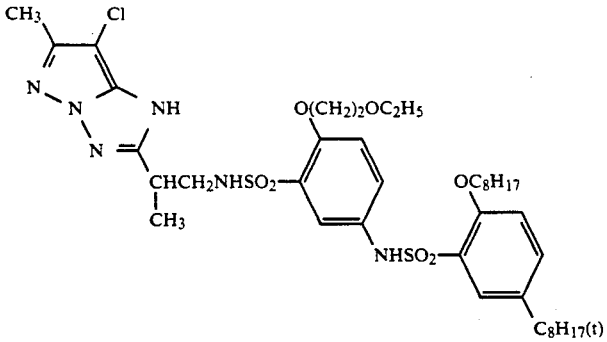 | 0.22 |
| 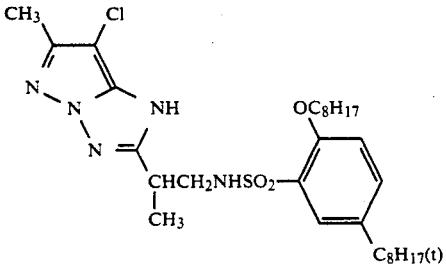 | 0.28 |
| 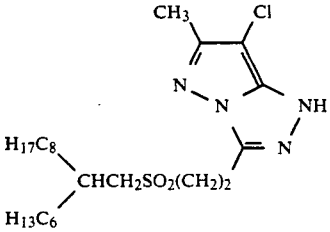 | 0.16 |
| 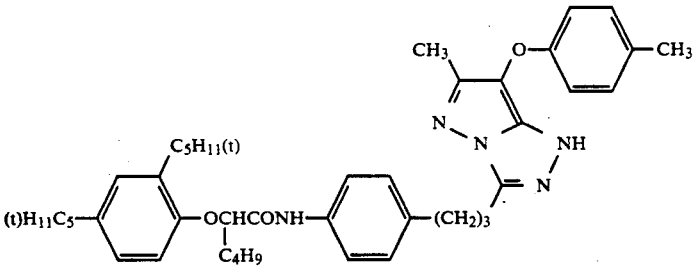 | 0.07 |
| 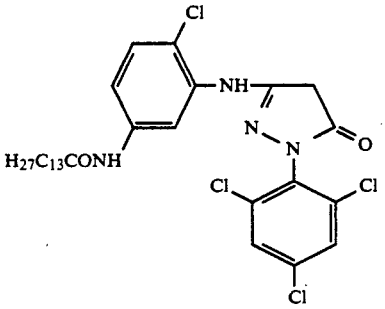 | 1.80 |

-continued

| Coupler | Coupling Rate |
|---|---|
| 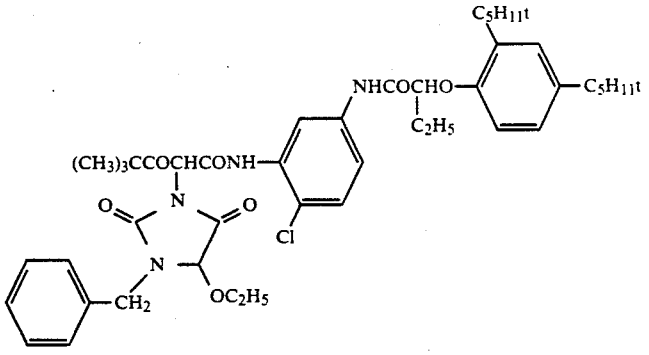 | 0.20 |
| 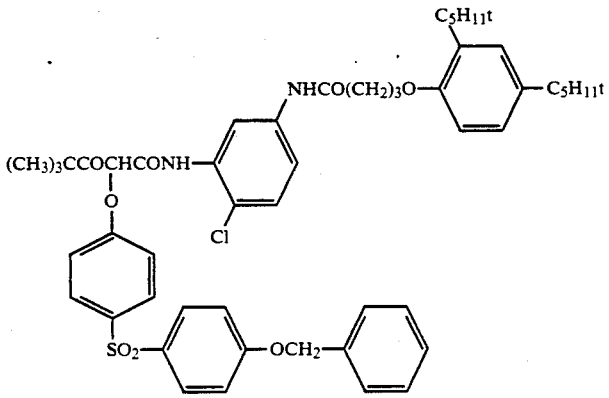 | 0.10 |
| 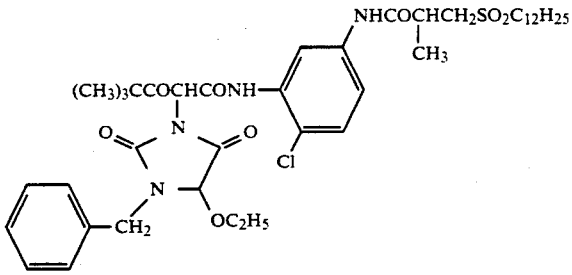 | 0.31 |
| 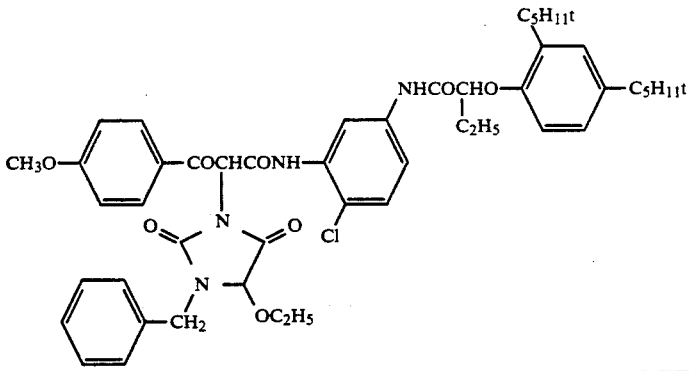 | 1.30 |

The average size of a droplet of the coupler in the emulsion in this invention is preferably in a range of 0.1 to 0.3 μm. Herein, the average particle size may be easily determined by a conventional method, and in the concrete by the method of Gledhill and Julian described in *J. Phys. Chem.*, 66,458 (1961).

In the present invention, it is satisfactory that the relative coupling rate (X) of the couplers used in the blue-sensitive emulsion layer, the green-sensitive emulsion layer, and the red-sensitive emulsion layer is 0.05 or over, and more preferably 0.10 or over. The upper limit of the coupling rate is preferably up to 10, for example in view of stain, in particular stain on the white background.

Usually the color couplers are used in an amount of 0.001 to 1 mol per mol of photosensitive silver halide. Preferred amounts of the couplers are 0.01 to 0.5 mol for yellow coupler, 0.003 to 0.3 mol for magenta coupler, 0.002 to 0.3 mol for cyan coupler, per mol of photosensitive silver halide, respectively.

The silver halide emulsion in the present invention consists substantially of silver chloride. Herein the term "substantially" means that the content of silver chloride based on the total amount of all silver halides is 80 mol % or over, preferably 95 mol % or over, and more preferably 98 mol % or over. In view of the rapidness, the higher the content of silver chloride, the more preferable.

Preferably the coating amount of silver of the present silver halide photographic material is 0.80 g/m$^2$ or below, in view of the rapidness, the bleach ability, and the prevention of pressure-sensitized streaks and the prevention of fluctuation of photographic quality. It is also considered that this includes, in addition to the reduction of the amount of silver, the effect due to the lowering of the film thickness. It is more preferable that the coating amount of silver is 0.75 g/m$^2$ or below, more preferably 0.65 g/m$^2$ or below, and down to 0.3 g/m$^2$, in view of the image density.

In the present invention, it is required that the color developer contains chloride ions in an amount of $3.5\times10^{-2}$ to $1.5\times10^{-1}$ mol/l. Preferably chloride ions are contained in an amount of $4.0\times10^{-2}$ to $1.0\times10^{-1}$ mol/l. If the concentration of ions exceeds $1.5\times10^{-1}$ mol/l, disadvantageously the development is made slow not leading to the attainment of the objects of the present invention such as rapid processing and high Dmax. On the other hand, if the concentration of chloride ions is less than $3.5\times10^{-2}$ mol/l, the streaked pressure-sensitized fogging is not prevented, further, the fluctuation of photographic characteristics (in particular, sensitivities of cyan, magenta, and yellow) involved in continuous processing becomes great, and the residual silver after processing is much in amount, not leading to the attainment of the objects of the present invention.

In the present invention, it is required that at the same time the color developer also contains bromide ions in an amount of $3.0\times10^{-5}$ to $1.0\times10^{-3}$ mol/l. Preferably bromide ions are contained in an amount of $5.0\times10^{-5}$ to $5\times10^{-4}$ mol/l. If the concentration of bromide ions is more than $1\times10^{-3}$ mol/l, the development is made slow, the maximum density and the sensitivity are made slow, and if the concentration of bromide ions is less than $3.0\times10^{-5}$ mol/l, the streaked pressure-sensitized fogging is not prevented, and the fluctuation of photographic characteristics (in particular, minimum density and maximum density) and poor desilvering are not prevented, not leading to the attainment of the objects of the present invention.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent that will be added to the developer.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

In the present invention, it is preferable to use the color-developer not containing sulfite ion substantially in view point of process-stability during the continuous processing and the prevention of pressure-sensitized streaks, but in order to restrain the retarioration of the developer, physical means, for example, to not use the developer for long time, and to use a floating cover or to decrease the opened surface-ratio in the developing bath to repress the effect of oxydation by air, and chemical means, for example, to control the temperature of developer, and to add an organic preservative, may be employed. Of these means the method of using an organic preservative is advantageous in view of convenience.

In the present invention, the term "organic preservative" means organic compounds generally that can reduce the rate of deterioration of aromatic primary amine color-developing agents when added to the processing solution for the color photographic material. That is, organic preservatives are organic compounds having a function to prevent color photographic agents from being oxidized with air or the like. Of these, hydroxylamine derivatives (excluding hydroxylamine, the same being applied hereinafter), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring-type amines are particularly effective. They are disclosed, for example, in JP-A Nos. 4235/1988, 30845/1988, 21647/1988, 44655/1988, 53551/1988, 43140/1988, 56654/1988, 581346/1988, and 43138/1988, European Patent Publication No. 254280, JP-A Nos. 44657/1988 and 44656/1988, U.S. Pat. Nos. 3,615,503 and 2,494,903, JP-A No. 143020/1987, and JP-B ("JP-B" means examined Japanese patent publication) No. 30496/1973.

Regarding the preferable organic preservatives mentioned above, their formulas and typical compounds are mentioned below, but the present invention is not limited to them.

It is desirable that the amount of the compounds mentioned below to be added to the color developer is 0.005 to 0.5 mol/l, and preferably 0.03 to 0.1 mol/l.

As hydroxylamine derivatives, compounds represented by the following formula (I) are preferable:

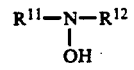

Formula (I)

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom. The ring structure of the heterocyclic ring is a 5- to 6-membered ring, it is made up of carbon atoms, halogen atoms, oxygen atoms, nitrogen atoms, sulfur atoms, etc., and it may be saturated or unsaturated.

It is preferable that $R^{11}$ and $R^{12}$ each represent an alkyl group or an alkenyl group having preferably 1 to 10 carbon atoms, more preferably 1 to 5 carbon atoms. As nitrogen-containing heterocyclic rings formed by bonding $R^{11}$ and $R^{12}$ together can be mentioned, for example, a piperidyl group, a pyrolidyl group, an N-alkylpiperazyl group, a morpholyl group, an indolinyl group, and a benztriazole group.

Preferable substituents of $R^{11}$ and $R^{12}$ are a hydroxyl group, an alkoxy group, an alkylsulfonyl group, an arysulfonyl group, an amido group, a carboxyl group, a cyano group, a sulfo group, a nitro group, and an amino group.

Exemplified compounds:

I-1 $C_2H_5-\underset{\underset{OH}{|}}{N}-C_2H_5$

I-2 $CH_3OC_2H_4-\underset{\underset{OH}{|}}{N}-C_2H_4-OCH_3$

I-3 $C_2H_5OC_2H_4-\underset{\underset{OH}{|}}{N}-CH_2-CH=CH_2$

I-4 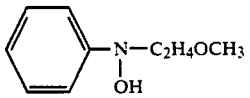

I-5 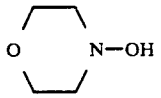

I-6 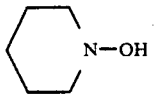

I-7 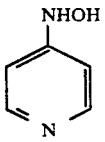

I-8 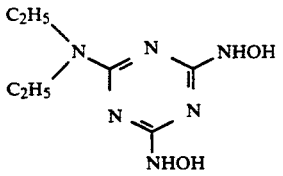

As hydrazines and hydrazides the following compounds are preferable:

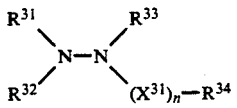

Formula (II)

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group. The heterocyclic group is a 5- or 6-membered ring made up of C, H, O, N, S, and/or a halogen atom, and it may be substituted or unsubstituted. $X^{31}$ represents a divalent group selected from —CO—, —$SO_2$—, and $$-\overset{\overset{NH}{\|}}{C}-;$$

n is 0 or 1, provided that when n=0, $R^{34}$ represents a group selected from an alkyl group, an aryl group, or a heterocyclic group. $R^{33}$ and $R^{34}$ may together form a heterocyclic ring.

In formula (II), $R^{31}$, $R^{32}$, and $R^{33}$ each are preferably a hydrogen atom or an alkyl group having 1 to 10 carbon atoms, particularly $R^{31}$ and $R^{32}$ each are most preferably a hydrogen atom.

In formula (II), $R^{34}$ is preferably an alkyl group having 1 to 20 carbon atoms, an aryl group having 6 to 20 carbon atoms, an alkoxy group having 1 to 20 carbon atoms, a carbamoyl group having 1 to 20 carbon atoms, or an amino group having 0 to 20 carbon atoms, in particular preferably an alkyl group or a substituted alkyl group. The preferable substituents of an alkyl group include a carboxyl group, a sulfo group, a nitro group, an amino group, and a phosphono group. $X^{31}$ is preferably —CO— or —$SO_2$—, most preferably —CO—.

Exemplified compounds:

II-1 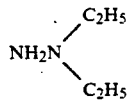

II-2 $NH_2NH(CH_2)_4SO_3H$

II-3 $NH_2NH(CH_2)_2OH$

II-4 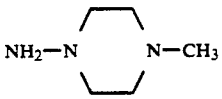

II-5 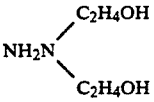

II-6 $NH_2NHCOCH_3$

II-7 $NH_2NHCOOC_2H_5$

II-8 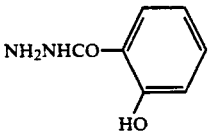

-continued

Exemplified compounds:

II-9

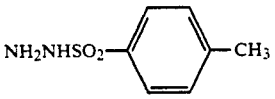

II-10 $NH_2NHCONH_2$

II-11

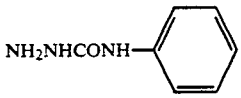

II-12 $NH_2NHSO_3H$

II-13 $NH_2NHC(=NH)NH_2$

II-14 $NH_2NHCOCONHNH_2$

II-15 $NH_2NHCH_2CH_2CH_2SO_3H$

II-16

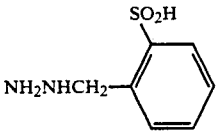

II-17 $NH_2NHCH(C_4H_9(n))COOH$

II-18 $NH_2NHCH_2CH_2COOH$

II-19 $NH_2N(CH_2COOH)_2$

II-20 $NH_2N(CH_2CH_2CH_2SO_3H)_2$

II-21

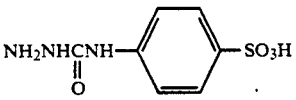

II-22

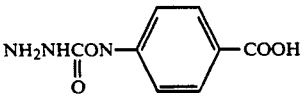

It is preferable to use the compound represented by formula (I) or (II) in combination with the compound represented by the following formula (III) or (IV), in view of hither stability of the color developer, that is, higher stability during continuous processing.

Formula (III)

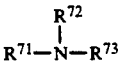

wherein $R^{71}$, $R^{72}$, and $R^{73}$ each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{72}$ and $R^{73}$ may bond together to form a nitrogen-containing heterocyclic group.

$R^{71}$, $R^{72}$, and $R^{73}$ may have a substituent. Particularly preferably $R^{71}$, $R^{72}$, and $R^{73}$ each represent a hydrogen atom or an alkyl group. As a substituent can 15 be mentioned, for example, a hydroxyl group, a sulfo group, a carboxyl group, a halogen atom, a nitro group, and an amino group.

Exemplified compounds:

III-1 $N(CH_2CH_2OH)_3$

III-2 $H_2NCH_2CH_2OH$

III-3 $HN(CH_2CH_2OH)_2$

III-4 $C_7H_{15}N(CH_2CH(OH)CH_2OH)_2$

III-5

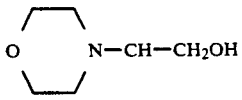

III-6

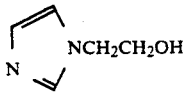

III-7

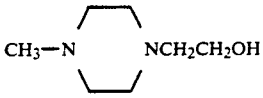

III-8

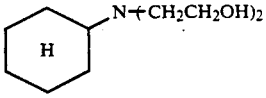

III-9

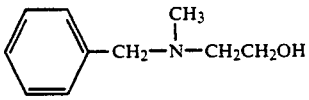

III-10 $(HOCH_2CH_2)_2NCH_2CH_2SO_2CH_3$

III-11 $HN(CH_2COOH)_2$

III-12 $HOOCCH_2CH_2CH(NH_2)COOH$

III-13 $H_2NCH_2CH_2SO_2NH_2$

III-14 $(C_2H_5)_2N-CH_2CH_2OCH_2CH_2OH$

III-15 $H_2N-C(CH_2OH)_2$

III-16 $HOCH_2CH(NH_2)COOH$

III-17

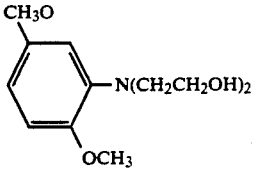

III-18

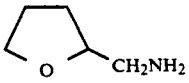

-continued

III-19

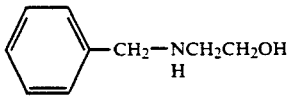

III-20

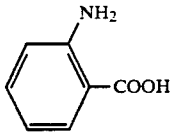

Formula (IV)

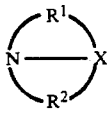

wherein X represents a trivalent group of atoms necessary to complete a condensed ring, and $R^1$ and $R^2$ each represent an alkylene group, an arylene group, an alkenylene group, or an aralkylene group.

$R^1$ and $R^2$ may be the same or different.

Of the compounds represented by formula (IV), particularly preferable compounds are those represented by formulas (IV-a) and (IV-b):

Formula (IV-a)

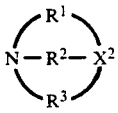

wherein $X^2$ represents

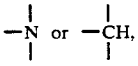

$R^1$ and $R^2$ have the same meaning as defined above for formula (IV), and $R^3$ has the same meaning as $R^1$ or $R^2$ or represents

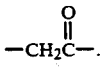

In formula (IV-a), preferably $X^2$ represents

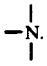

Preferably the number of carbon atoms of $R^1$, $R^2$, and $R^3$ is 6 or below, more preferably 3 or below, and most preferably 2.

Preferably $R^1$, $R^2$, and $R^3$ each represent an alkylene group or an arylene group, most preferably an alkylene group.

Formula (IV-b)

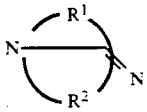

wherein $R^1$ and $R^2$ have the same meaning as defined in formula (IV).

In formula (IV-b), preferably the number of carbon atoms of $R^1$ and $R^2$ is 6 or below. Preferably $R^1$ and $R^2$ each represent an alkylene group or an arylene group, most preferably an alkylene group.

Of compounds represented by formulae (IV-a) and (IV-b), those represented by formula (IV-a) are preferable.

IV-1

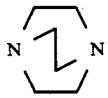

IV-2

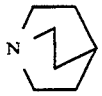

IV-3

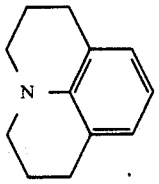

IV-4

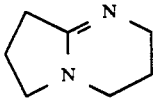

IV-5

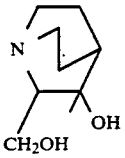

IV-6

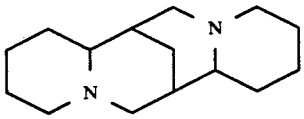

IV-7

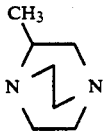

IV-8

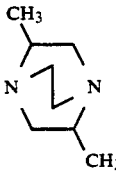

-continued

IV-9

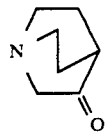

IV-10

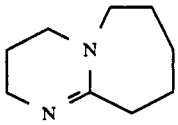

IV-11

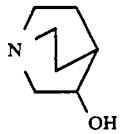

IV-12

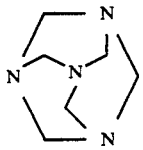

IV-13

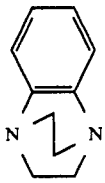

IV-14

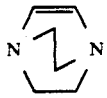

IV-15

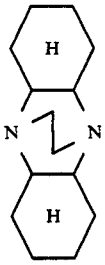

IV-16

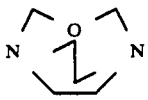

IV-17

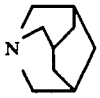

IV-18

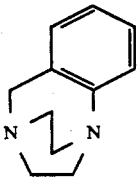

The above-mentioned organic preservations can be commercially available, but they can also be synthesized by methods described, for example, in JP-A Nos. 170642/1988 and 239447/1988, Details of color developers used in the present invention will now be described.

The color-developer for use in the present invention may contain a known aromatic primary amine color-developing agent. Preferred examples are p-phenylenediamine derivatives. Representative examples are given below, but they are not meant to limit the present invention:

D-1: N,N-Diethyl-p-phenylenediamine

D-2:4-[N-Ethyl-N-(β-hydroxyethyl)amino]aniline

D-3:2-Methyl-4-[N-ethyl-N-(β-hydroxyethyl)amino]-aniline

D-4:4-Amino-3-methyl-N-ethyl-N-(β-methanesulfonamido ethyl)aniline.

These p-phenylenediamine derivatives may be in the form of salts, such as sulfates, hydrochloride, sulfites, and p-toluenesulfonates.

The amount of developing agent to be used is preferably about 0.1 g to about 20 g, more preferably about 0.5 g to about 10 g, per liter of developer.

Preferably the color developer used in the present invention has a pH of 9 to 12, and more preferably 9 to 11.0, and it can contain other known developer components.

In order to keep the above pH, it is preferable to use various buffers. As buffers, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific examples are shown below, but the present invention is not limited to them: nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer. As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

It is preferable that the color developer of the present invention is substantially free from benzyl alcohol. Herein the term "substantially free from" means that the amount of benzyl alcohol is 2.0 ml or below per liter of the developer, or preferably benzyl alcohol is not contained in the developer at all, because of being the fluctuation of photographic characteristics little.

In the present invention, if necessary, any antifoggant can be added in addition to chloride ion and bromide ion. As antifoggants, use can be made of alkali metal halides, such as potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 10 g/l, and preferably 0.1 to 6 g/l.

If necessary, various surface-active agents, such as alkyl sulfonates, aryl sulfonates, aliphatic acids, and aromatic carboxylic acids.

The processing temperature of the color developer of the invention is 20° to 50° C., and preferably 30° to 40° C. The processing time is 20 sec to 5 min, and preferably 30 sec to 2 min.

In the color developing, the developer is usually replenished. The replenishing amount is generally in the range of about 180 to 1000 ml per square meter of the photographic material, although it is depending on the photographic material to be processed. Replenishing is a mean to keep the constituent of color developer to be constant in order to avoid the change of finishing characteristics due to the change of constituent concentration in a development processing, such as a continuous processing for a large amount of photographic materials, for example, using an automatic processor, but is is preferable that the amount is as small as possible, in view of economy and pollution, because of a large amount of overflowed solution by replenishing. The preferable replenishing amount is 20 to 150 ml per square meter of the photographic material. The replenishing amount of 20 ml per square meter of the photographic material means that the carried-over amount of developer by the photographic material is almost equal to the replenishing amount, although the amount differs a little depending on the photographic material. The effect of the present invention can be attained at the processing carried out in such a low replenishing amount.

In the present invention, a desilvering process is carried out following a color-developing process. The desilvering process consists usually of a bleaching process and a fixing process, but it is particularly preferable to carried out the two process at the same time.

Further, the bleaching solution or the bleach-fixing solution used in the present invention can contain rehalogation agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contain, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution according to the present invention can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanediol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol.

The pH range of the bleach-fixing solution or the fixing solution is preferably 3 to 10, and particularly preferably 5 to 9. If the pH is lower than this range, the desilvering is improved, but the deterioration of the solution and the leucolization of cyan dye are accelerated. In reverse, if the pH is higher than this range, the desilvering is retarded and stain is liable to occur.

To adjust pH, if necessary, a compound such as hydrochloric acid, sulfuric acid, nitric acid, acetic acid, bicarbonate, ammonia, caustic potassium, caustic soda, sodium carbonate and potassium carbonate may be added.

Further, the bleach-fixing solution may additionally contain various brightening agents, anti-foaming agents, surface-active agents, polyvinyl pyrrolidone, and organic solvents, such as methanol.

The bleach-fixing solution or the fixing solution used in the present invention contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.50 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelate agents, anti-foaming agents, and mildewproofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television Engineers*, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. But a problem arises that bacteria can propagate due to the increase in the residence time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zaiJiten* (edited by Nihon Bokin Bobai-gakkai), can be used.

The pH range of the washing water in the processing steps for the photographic material of the present invention may be 4 to 9, preferably 5 to 8. The temperature and time of washing, which can be set according to the use or property of the photographic material, is generally in the range 15 to 45 C and 20 sec. to 10 min, preferably 25 to 40 C and 30 sec to 5 min.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1,1-diphosphonate, 5-chloro-2-methyl-4-isothiazolone-3-one, a bismuth compound, or an ammonium compound.

In some cases a stabilizing process is carried out following the above-described washing process, and an example of such cases is a stabilizing bath containing formalin and a surfaceâctive agent for use as a final bath for color photographic materials for photographing.

The time of processing process of the present invention is defined as the period from when the photographic material contacts the color developer to when it comes out of the last bath (generally, washing bath or stabilizing bath), and the effect of the present invention can be remarkably exhibited in such a rapid processing that the processing time being 4 min 30 sec or below, preferably 4 min or below.

Next, details of the silver halide color photographic material for use in the present invention will be described below.

The silver halide emulsion for use in the present invention comprises substantially silver chloride as described above. Small amount of silver bromide and/or silver iodide may be contained in the high-silver chloride emulsion of the present invention. In these cases, many useful effects on photo-sensitivity can be obtained, to increase the amount of light-absorption, increase the adsorption of spectrally-sensitizing dye, and to decrease the desensitization due to spectrally-sensitizing dye.

The silver halide grains contained in the silver halide emulsions of the photographic materials to be used in the present invention may be of such a structure that the internal phase differs from the surface phase, the entire grains may have a uniform phase, they may be polyphase with a joining structure, or mixture thereof.

The silver halide grains in the photographic emulsions may have a regular crystal structure such as cubic, octahedral, or tetradecanhedral, an irregular crystal such as spherical or tabular, a crystal having crystal defects such as twin planes, or a thereof composite crystal structure.

The grain size of the silver halide may be fine grains having a diameter of about 0.2 μm or less, or coarse grains with the diameter of the projected area being down to 10 μm, and a polydisperse emulsion or a monodisperse emulsion can be used.

The silver halide photographic emulsion for use in the present invention can be prepared by the process described, for example, in *Research disclosure* (RD) No. 17643 (December., 1978), pp. 22–23, "*I. Emulsion preparation and Types*".

A monodisperse emulsion described, for example, in U.S. Pat. Nos. 3,574,628 and 3,655,394, and British Patent No. 1,413,748 is also preferably.

Tabular grains having an aspect ratio of 5 or more can be used in the present invention. Tabular grains may be easily prepared by suitably using the methods described, for example, in Gutoff: *Photographic Science and Engineering*, Vol. 14, pp. 248–257 (1970): U.S. Pat. Nos. 4,44,226, 4,414,310, 4,433,048, and 4,439,520; and British Patent No. 2,112,157.

The crystal structure may be uniform, the outer halogen composition may be different from the inner halogen composition, or the crystal structure may be layered. The halide composition may be joined by the epitaxial joint to a different silver halide composition or a compound other than silver halide, for example silver rhodanide or lead oxide, is jointed.

Further, a mixxture of different crystal structures can be used.

Generally, the emulsion to be used in the present invention may be physically ripened, chemically ripened, and spectrally sensitized. Additives to be used in these steps are described in *Research Disclosure* Nos.

17643 and 18716, and the involved sections are listed in the Table below.

Known photographic additives that can be used in the present invention are also discribed in the above-mentioned two Research Disclosures, and the involved sections are listed in the same Table.

| Additive | RD 17643 | RD 18716 |
|---|---|---|
| 1 Chemical sensitizer | p. 23 | p. 648 (right column) |
| 2 Sensitivity-enhancing agents | p. 23 | p. 648 (right column) |
| 3 Spectral sensitizers, Supersensitizers | pp. 23–24 | pp. 648 (right column)–649 (right column) |
| 4 Brightening agents | p. 24 | — |
| 5 Antifogging agents and Stabilizers | pp. 24–25 | p. 648 (right column) |
| 6 Light absorbers, Filter dyes and UV absorbers | pp. 25–26 | pp. 649 (right column)–650 (right column) |
| 7 Stain-preventive agents | p. 25 (right column) | p. 650 (left to right (column) |
| 8 Image-dye stabilizers | p. 25 | — |
| 9 Hardeners | p. 26 | p. 651 (left column) |
| 10 Binders | p. 26 | " |
| 11 Plasticizers and Lubricants | p. 27 | p. 650 (right column) |
| 12 Coating aids and Surface-active agents | pp. 26–27 | " |
| 13 Antistatic agents | p. 27 | " |

Various color couplers other than the above-mentioned, insofar as the X-value being 0.05 or over, may be used in the present invention, and typical examples thereof are described in the patents cited in *Research Disclosure* (RD) No. 17643, VII-C - G.

As yellow couplers, those described, for example, in U.S. Pat. Nos. 3,933,501, 4,022,620, 4,326,024, and 4,401,752, JP-B No. 10793/1983, and British Patent Nos. 1,425,020 and 1,476,760 may be used preferably.

As magenta couplers, the 5-pyrazolone series and pyrazoloazole series are preferable, and those described, for example, in U.S. Pat. Nos. 4,310,619 and 4,351,897, European Patent No. 73,636, U.S. Pat. Nos. 3,061,432 and 3,725,067, *Research Disclosure* No. 24220 (June, 1984), JP-A No. 33552/1985, *Research Disclosure* No. 24230 (June, 1984), JP-A No. 43659/1985, and U.S. Pat. Nos. 4,500,630 and 4,540,654 are particularly preferable.

As cyan couplers can be mentioned phenol series couplers and naphthol series couplers, and those described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent (OLS) No. 3,329,729, European Patent No. 121,365A, U.S. Pat. Nos. 3,446,622, 4,333,999, 4,451,559, 4,427,767, 4,690,889, 4,254,212, and 4,296,199 European Patent No. 161,626A, and JP-A No. 42658/1986 are preferable.

As a colored coupler to correct the undesired absorption of color-forming dyes, those couplers described in paragraph VII-G of *Research Disclosure* No. 17643, U.S. Pat. No. 4,163,670, JP-B No. 39413/1982, U.S. Pat. Nos. 4,004,929 and 4,138,258, and British Patent No. 1,146,368 are preferable.

As a coupler which forms a dye having proper diffusibility, those described in U.S. Pat. No. 4,366,237, British Patent No. 2,125,570, European Patent No. 96,570, and West German Patent Application (OLS) No. 3,234,533 are preferable.

Typical examples of a polymerized dye-forming coupler are described in U.S. Pat. Nos. 3,451,820, 4,080,211, and 4,367,282, and British Patent No. 2,102,173.

A coupler that releases a photographically useful residue can be used favorably in this invention. As a DIR coupler that releases a development retarder, those described in patents cited in paragraph VII-F of the above-mentioned *Research Disclosure* No. 17643, JP-A Nos. 151944/1982, 154234/1982, and 184248/1985, and U.S. Pat. No. 4,248,962 are preferable.

As a coupler which releases, imagewise, a nucleating agent or a development accelerator upon developing, those described in British Patent Nos. 2,097,140 and 2,131,188, and JP-A Nos. 157638/1984 and 170840/1984 are preferable.

Other couplers that can be incorporated in the photographic material of this invention include competitive couplers described in U.S. Pat. No. 4,130,427, multiequivalent couplers described in U.S. Pat. Nos. 4,283,472, 4,338,393, and 4,310,618, DIR couplers that release a redox compound, as described, for example, in JP-A No. 185950/1985, and couplers that release a dye to regain a color after releasing, as described in European Patent No. 173,302A.

The couplers to be used in this invention can be incorporated to photographic materials by various known dispersing processes.

Examples of a high-boiling organic solvent for use in the oil-in-water dispersing process are described, for example, in U.S. Pat. No. 2,332,027.

The steps and effects of the latex dispersion method and examples of latex for impregnation are described, for example, in U.S. Pat. No. 4,199,363 and West German Patent Application (OLS) Nos. 2,541,274 and 2,541,230.

Suitable bases for use in the present invention are described, for example, on page 28 of the above-mentioned RD. No. 17643, and on the right column of page 627 to the left column of page 648 in RD. No. 18716.

The present invention can be applied to any of color photographic materials such as, for example, color negative film, color reversal film (coupler-in-emulsion type and coupler-in-developer type), color paper, color positive film, color reversal paper, color diffusion transfer process, and direct positive color photographic material. However, it is preferably applied to, in particular, color negative film, color reversal film, and color reversal paper.

Now the present invention will be described in detail with reference to examples, but the invention is not limited to them.

EXAMPLE 1

A multilayer color photographic paper having layer-compositions described below was prepared by coating on a paper laminated on both sides with polyethylene. Coating solutions were prepared as follows:

PREPARATION OF THE FIRST-LAYER COATING SOLUTION

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-3) were added and dissolved. The resulting solution was dispersed and emulsified in 185 ml of 10% aqueous gelatin solution containing 8 ml of sodium dodecylbenzensulfonate. Separately another emulsion was prepared by adding two kinds of blue-sensitive sensitizing dye, shown below, to a silver chlorobromide emulsion (cubic grains having 0.88 μm of grain size and 0.08 of deviation coefficient of grain size distribution, in which 0.2 mol% of silver bromide based on all the grains was localized at the surface of the grains) in such an amount that each sensitizing dye is $2.0\times10^{-4}$ mol per mol of silver, and then by sulfur-sensitizing. The thus-prepared emulsion was mixed with and dissolved in the above-obtained emulsified dispersion to give the composition shown below, thereby preparing the first-layer coating solution. Coating solutions for the second to seventh layers were also prepared in the same manner as in the first layer coating solution. As a gelatin hardener for the respective layers, 1-hydroxy-3,5-dichloro-s-triazine sodium salt was used.

As spectral-sensitizing dyes for the respective layers, the following compounds were used:

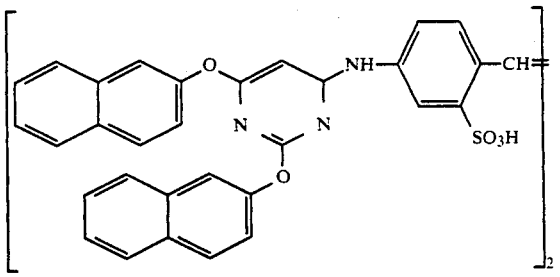

Further, 1-(5-methylureidophenyl)-5-mercaptotetrazole was added to the blue-sensitive emulsion layer, the green-sensitive emulsion layer, and the redsensitive emulsion layer in amounts of $8.5\times10^{-5}$ mol, $7.7\times10^{-4}$ mol, and $2.5\times10^{-4}$ mol per mol of silver halide, respectively.

The following dyes were added to the emulsion layers to prevent irradiation.

Blue-sensitive emulsion layer:

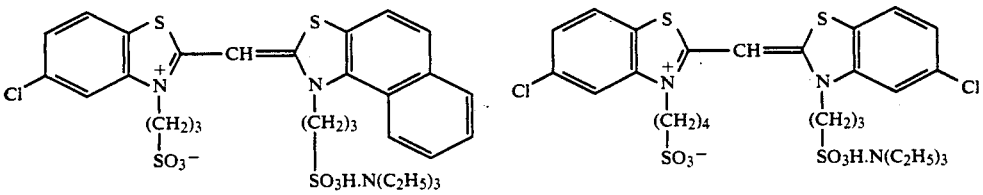

(The above two dyes were added each in an amount of $2.0\times10^{-4}$ mol per mol of silver halide.)

Green-sensitive emulsion layer:

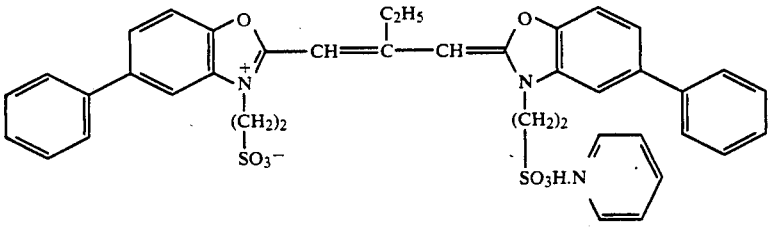

($4.0\times10^{-4}$ mol per mol of silver halide)

and

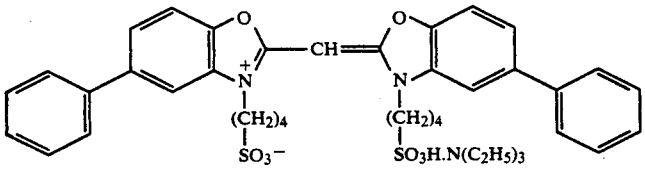

($7.0\times10^{-4}$ mol per mol of silver halide)

Red-sensitive emulsion layer:

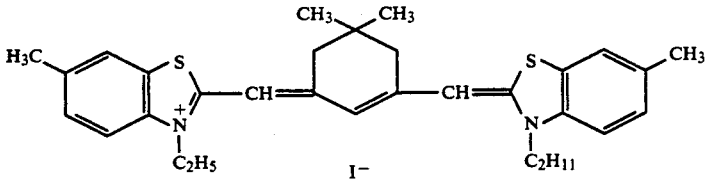

($0.9\times10^{-4}$ mol per mol of silver halide)

To the red-sensitive emulsion layer, the following compound was added in an amount of $2.6\times10^{-3}$ mol per mol of silver halide.

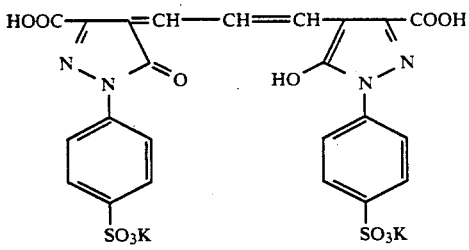

and

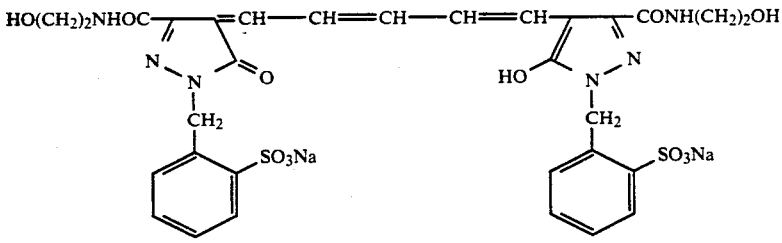

Compositions of Layers

The composition of each layer is shown below. The figures represent coating amounts (g/m$^2$). The coating amount of each silver halide emulsion is represented in terms of silver.

| | |
|---|---|
| Base | |
| Paper laminated on both sides with polyethylene (a white pigment, $TiO_2$, and a bluish dye, ultramarine, were included in the first layer side of the polyethylene film laminated.) | |
| First Layer: Blue-sensitive emulsion layer | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-3) | 0.35 |
| Image-dye stabilizer (Cpd-7) | 0.06 |
| Second Layer: Color mix preventing layer | |
| Gelatin | 0.99 |
| Color mix inhibitor (Cpd-5) | 0.08 |
| Solvent (Solv-1) | 0.16 |
| Solvent (Solv-4) | 0.08 |
| Third Layer: Green-sensitive emulsion layer | |
| Silver chlorobromide emulsion (mixture of in Ag molar ratio of 1:3 of two kinds of cubic grains having 0.55 μm and 0.39 μm of average grain sizes, and 0.10 and 0.08 of deviation coefficients of grain size distribution, respectively, in which each 0.8 mol % of AgBr based on all the grains was localized on the grain surface) | 0.12 |
| Gelatin | 1.24 |
| Magenta coupler (ExM) | 0.27 |
| Image-dye stabilizer (Cpd-3) | 0.15 |
| Image-dye stabilizer (Cpd-8) | 0.02 |
| Image dye stabilizer (Cpd-9) | 0.03 |
| Solvent (Solv-2) | 0.54 |
| Fourth Layer: Ultraviolet light absorbing layer | |
| Gelatin | 1.58 |
| Ultraviolet absorber (UV-1) | 0.47 |
| Color mix inhibitor (Cpd-5) | 0.05 |
| Solvent (Solv-5) | 0.24 |
| Fifth Layer: Red-sensitive emulsion layer | |
| Silver chlorobromide emulsion (mixture of in Ag molar ratio of 1:4 of two kinds of cubic grains having 0.58 μm and 0.45 μm of average grain sizes, and 0.09 and 0.11 of deviation coefficients of grain size distribution, respectively, in which each 0.6 mol % of AgBr based on all the grains was localized on the grain surface) | 0.23 |
| Gelatin | 1.34 |
| Cyan coupler (ExC) | 0.32 |

-continued

| | |
|---|---|
| Image-dye stabilizer (Cpd-6) | 0.17 |
| Image-dye stabilizer (Cpd-10) | 0.04 |
| Image-dye stabilizer (Cpd-7) | 0.40 |
| Solvent (Solv-6) | 0.15 |
| Sixth Layer: Ultraviolet light absorbing layer | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh Layer: Protective layer | |
| Gelatin | 1.33 |
| Acryl-modified copolymer of polyvinyl alcohol (Modification degree: 17%) | 0.17 |
| Liquid paraffin | 0.03 |

Compounds used are as follows:

(ExY) Yellow coupler

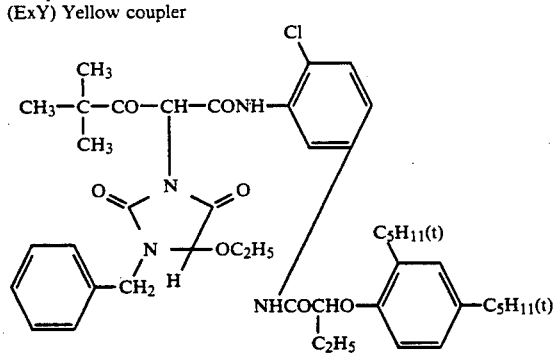

(ExM) Magenta coupler

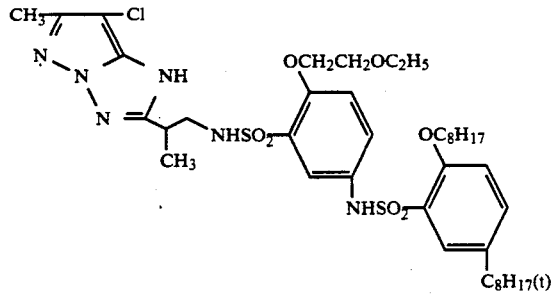

(ExC) Cyan coupler

-continued

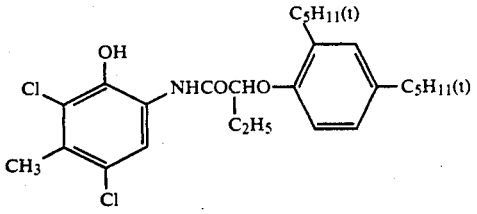

(Cpd-1) Image-dye stabilizer

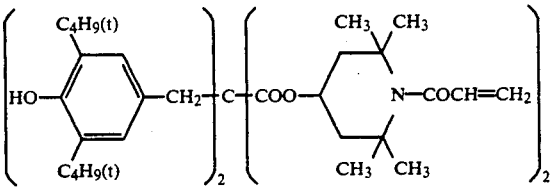

(Cpd-3) Image-dye stabilizer

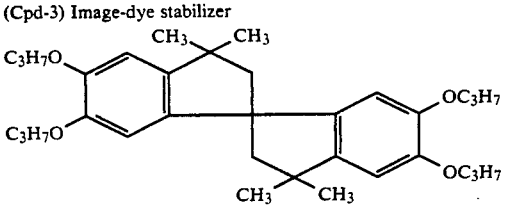

(Cpd-5) Color-mix inhibitor

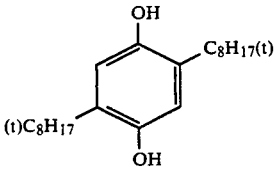

(Cpd-6) Image-dye stabilizer (mixture of 2:4:4 in weight ratio)

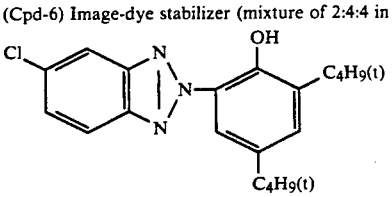

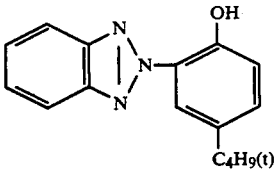

and

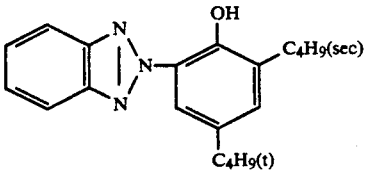

(Cpd-7) Image-dye stabilizer $$\left(CH_2-\underset{\underset{CONHC_4H_9(t)}{|}}{CH}\right)_n$$

(average molecular weight: 60,000)

(Cpd-8) Image-dye stabilizer

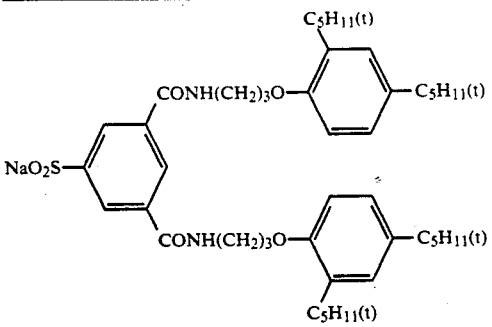

(Cpd-9) Image-dye stabilizer

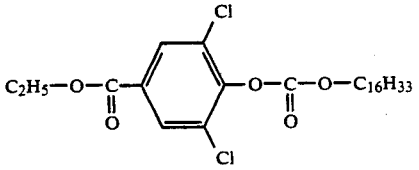

(Cpd-10) Image-dye stabilizer

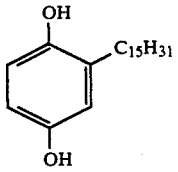

(UV-1) Ultraviolet absorber (mixture of 4:2:4 in weight ratio)

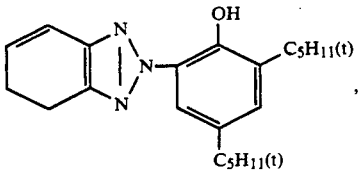

,

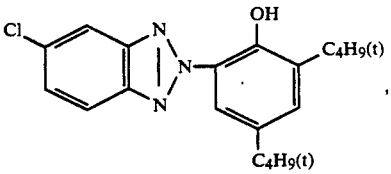

, and

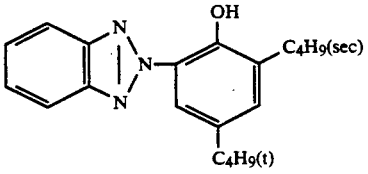

(Solv-1) Solvent

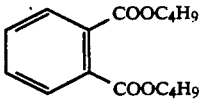

(Solv-2) Solvent (mixture of 2:1 in volume ratio)

$$O{=}P\left(OCH_2\underset{\underset{C_2H_5}{|}}{C}HC_4H_9\right)_3$$ and

-continued

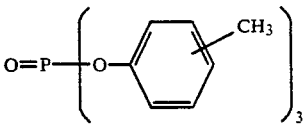

(Solv-3) Solvent $O{=}P{+}O{-}C_9H_{19}(iso))_3$ (Solv-4) Solvent

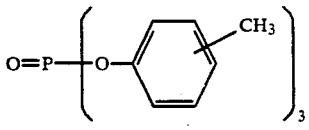

(Solv-5) Solvent $COOC_8H_{17}$·
|
$(CH_2)_8$
|
$COOC_8H_{17}$ (Solv-6) Solvent

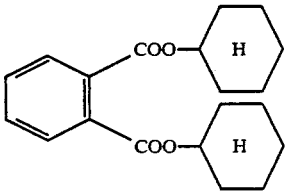

The thus-prepared sample is designated photographic material sample 1-1.

Coupling rates of couplers in the photographic material were evaluated by the above-described method. The results were as follows:

| Coupler | Coupling Rate |
|---|---|
| ExY | 0.20 |
| ExM | 0.22 |
| ExC | 0.15 |

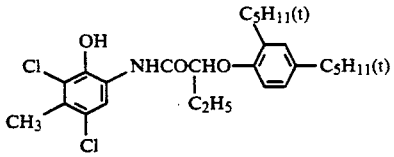

Samples 1-2 to 1-4 were prepared in the same manner as Sample 1-1, except that the halogen compositions of silver halide emulsion in the first, third, and fifth layer were changed to the composition as shown in Table 1, respectively.

TABLE 1

| Sample | Halogen composition in emulsion (Cl mol %) | | |
|---|---|---|---|
| | 1st layer (BL) | 3rd layer (GL) | 5th layer (RL) |
| 1-1 | 99.3 | 99.3 | 98.0 |
| 1-2 | 90.0 | 95.0 | 85.0 |
| 1-3 | 80.0 | 80.0 | 80.0 |
| 1-4 | 70.0 | 70.0 | 70.0 |

To investigate the photographic characteristics of these samples, the following tests were conducted.

First, each of samples was subjected to a gradation exposure to three separated colors for sensitometry using a sensitometer (FMH model made by Fuji Photo Film Co., Ltd., the color temperature of light source was 3200° K.). At that time, the exposure was carried out in such a manner that the exposure was 250 CMS with the exposure time being 0.1 sec.

After exposure to light, each sample was subjected to a processing as described below using the processing solutions, each composition of which is described below, by an automatic processor. The compositions of color developers were varied as shown in Table 2.

| Processing steps | | |
|---|---|---|
| Step | Temperature | Time |
| Color Development | 38° C. | 45 sec. |
| Bleach-fixing | 30-36° C. | 45 sec. |
| Rinsing ① | 30-37° C. | 30 sec. |
| Rinsing ② | 30-37° C. | 30 sec |
| Rinsing ③ | 30-37° C. | 30 sec. |
| Drying | 70-80° C. | 60 sec. |

The compositions of the respective processing solutions were as follows:

| | |
|---|---|
| Color developer | |
| Water | 800 ml |
| Ethylene-N,N,N',N'-tetramethylene phophonic acid | 3.0 g |
| Organic preservative (II-19) | 0.03 mol |
| Sodium chloride | see Table 2 |
| Potassium bromide | see Table 2 |
| Potassium carbonate | 25 g |
| N-Ethyl-N-(β-methanesulfonamidoethyl)-3-methyl-4-aminoaniline sulfate | 5.0 g |
| Triethanolamine | 10.0 g |
| Fluorescent brightening agent (4,4-diaminostilbene series) | 2.0 g |
| Water to make | 1000 ml |
| pH (25° C.) | |
| Bleach-fixing solution | |
| Water | 400 ml |
| Ammonium thiosulfate (70%) | 100 ml |
| Sodium sulfite | 17 g |
| Iron(III) ammonium ethylenediamine-tetraacetate dihydrate | 55 g |
| Disodium ethylenediaminetetraacetate | 5 g |
| Ammonia bromide | 40 g |
| Glacial acetic acid | 9 g |
| Water to make | 1000 ml |
| pH (25° C.) | |
| Rinsing solution | |
| Ion-exchanged water (each content of calcium and magnesium was 300 ppm or below) | |

Maximum densities (Dmax) of blue (B), green (G), and red (R) after the above sensitometry were determined by Macbeth densitometer. Results are shown in Table 2.

Separately the above-described coated samples were subjected to a gray uniform exposure using a sensitometer (FWH Model, made by Fuji Photo Film Co., Ltd., the color temperature of light source: 3200° K.) and were processed in the same manner as the above sensitometry, then the pressure-sensitized streaks formed were evaluated. The evaluation was graded into the following four classes:

| Evaluation of Sensitized Streaks | Number of Sensitized Streaks per 100 $cm^2$ (10 cm × 10 cm) of sample |
|---|---|
| ○ | nil |
| Δ | 1 to 2 |

-continued

| Evaluation of Sensitized Streaks | Number of Sensitized Streaks per 100 $cm^2$ (10 cm × 10 cm) of sample |
|---|---|
| X | 3 to 5 |
| XX | 6 or over |

TABLE 2

| Processing Process No. | Sample No. | Halide Ion Concentration in Developer (mol/l) $Cl^-$ | $Br^-$ | Dmax Cyan | Magenta | Yellow | Sensitized Streak Fogging | Remarks |
|---|---|---|---|---|---|---|---|---|
| 1 | 1-1 | $3.0 \times 10^{-2}$ | — | 2.81 | 2.55 | 2.43 | XX | Comparative Example |
| 2 | " | " | $3.0 \times 10^{-5}$ | 2.79 | 2.53 | 2.44 | X | " |
| 3 | " | $5.0 \times 10^{-2}$ | $1.0 \times 10^{-5}$ | 2.80 | 2.54 | 2.42 | Δ | " |
| 4 | " | $3.5 \times 10^{-2}$ | $3.0 \times 10^{-5}$ | 2.79 | 2.54 | 2.41 | ○ | This Invention |
| 5 | " | $5.0 \times 10^{-2}$ | $1.5 \times 10^{-4}$ | 2.78 | 2.52 | 2.40 | ○ | " |
| 6 | " | $4.0 \times 10^{-2}$ | $6.0 \times 10^{-5}$ | 2.79 | 2.51 | 2.43 | ○ | " |
| 7 | " | $1.0 \times 10^{-1}$ | $2.0 \times 10^{-4}$ | 2.81 | 2.52 | 2.40 | ○ | " |
| 8 | " | $1.5 \times 10^{-1}$ | $1.0 \times 10^{-3}$ | 2.78 | 2.48 | 2.37 | ○ | " |
| 9 | " | $2.0 \times 10^{-1}$ | $1.0 \times 10^{-4}$ | 2.65 | 2.34 | 2.09 | ○ | Comparative Example |
| 10 | " | $1.0 \times 10^{-1}$ | $5.0 \times 10^{-3}$ | 2.61 | 2.31 | 2.03 | ○ | " |
| 11 | 1-2 | $3.0 \times 10^{-2}$ | $3.0 \times 10^{-5}$ | 2.78 | 2.49 | 2.39 | X | " |
| 12 | " | $5.0 \times 10^{-2}$ | $1.5 \times 10^{-4}$ | 2.78 | 2.48 | 2.37 | ○ | This Invention |
| 13 | " | $1.0 \times 10^{-1}$ | $5.0 \times 10^{-3}$ | 2.59 | 2.31 | 2.02 | ○ | Comparative Example |
| 14 | 1-3 | $3.0 \times 10^{-2}$ | $3.0 \times 10^{-5}$ | 2.77 | 2.46 | 2.38 | Δ | " |
| 15 | " | $5.0 \times 10^{-2}$ | $1.5 \times 10^{-4}$ | 2.76 | 2.47 | 2.35 | ○ | This Invention |
| 16 | " | $1.0 \times 10^{-1}$ | $5.0 \times 10^{-3}$ | 2.56 | 2.30 | 2.01 | ○ | Comparative Example |
| 17 | 1-4 | $3.0 \times 10^{-2}$ | $3.0 \times 10^{-5}$ | 2.62 | 2.25 | 1.77 | X | " |
| 18 | " | $5.0 \times 10^{-2}$ | $1.5 \times 10^{-4}$ | 2.60 | 2.20 | 1.70 | ○ | " |
| 19 | " | $1.0 \times 10^{-1}$ | $5.0 \times 10^{-3}$ | 2.53 | 2.09 | 1.50 | ○ | " |

As is apparent from the results in Table 2, in processing processes 4 to 8, 12, and 15 where the photographic material Samples 1-1 to 1-3 of the present invention were processed by the developer according to the present invention, it can be seen that each of maximum density is high and the fogging of sensitized streaks is restrained.

EXAMPLE 2

Samples 2-1 to 2-6 were prepared in the same manner as Sample 1-1 in Example 1, except that couplers used in the first, third, and fifth layers were changed to those, in an equimolecular amount, as shown in Table 3.

TABLE 3

| Sample | Coupler | Coupling Rate | Remarks |
|---|---|---|---|
| 2-1 | 1st layer: ExY in Example 1 | 0.20 | This Invention |
| | 3rd layer: ExM in Example 1 | 0.22 | |
| | 5th layer: C-1 | 0.30 | |
| 2-2 | 1st layer: ExY in Example 1 | 0.20 | Comparative Example |
| | 3rd layer: ExM in Example 1 | 0.22 | |
| | 5th layer: C-2 | 0.03 | |
| 2-3 | 1st layer: ExY in Example 1 | 0.20 | This Invention |
| | 3rd layer: M-1 | 1.50 | |
| | 5th layer: ExC in Example 1 | 0.15 | |
| 2-4 | 1st layer: ExY in Example 1 | 0.20 | Comparative Example |
| | 3rd layer: M-2 | 0.04 | |
| | 5th layer: ExC in Example 1 | 0.15 | |
| 2-5 | 1st layer: Y-1 | 0.30 | This Invention |
| | 3rd layer: ExM in Example 1 | 0.22 | |
| | 5th layer: ExC in Example 1 | 0.15 | |
| 2-6 | 1st layer: Y-2 | 0.03 | Comparative Example |
| | 3rd layer: ExM in Example 1 | 0.22 | |
| | 5th layer: ExC in Example 1 | 0.15 | |

Note:

C-1

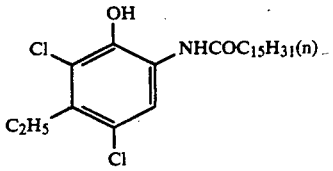

C-2

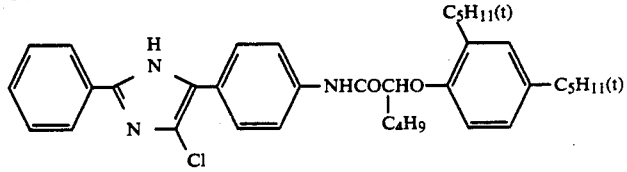

M-1

TABLE 3-continued

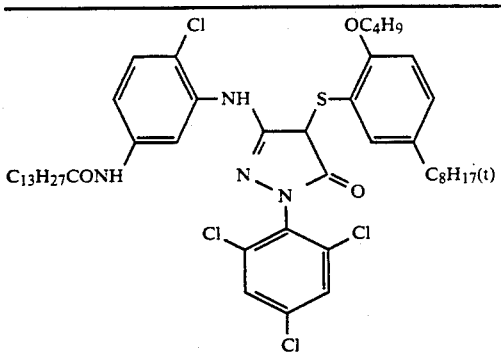

M-2

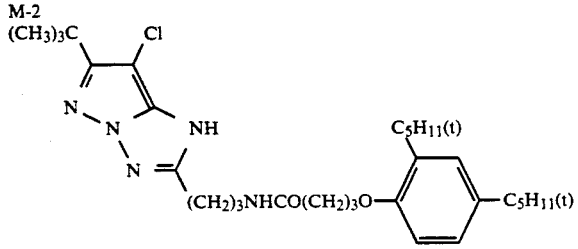

Y-1

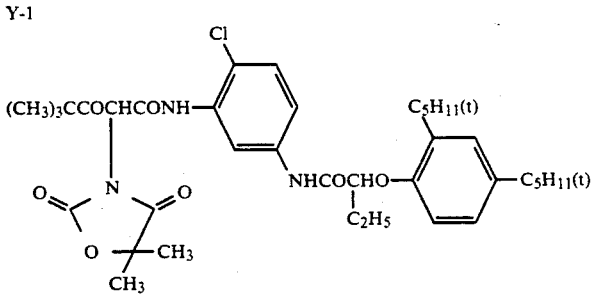

Y-2

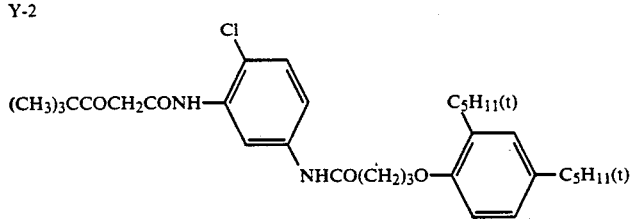

Samples 2-1 to 2-6 and Sample 1-1 in Example 1 were subjected to an exposure to light image-wise and to a continuous processing (running test) according to the following processing steps and the processing solutions having given composition by a color paper-processor until the replenishing amount of color developer reached 2-times as much as the tank volume.

Processing steps

| Step | Temperature | Time | Replenisher Tank Amount* | Replenisher Tank Volume |
|---|---|---|---|---|
| Color Development | 38° C. | 45 sec | 109 ml | 4 l |
| Bleach-fixing | 30–36° C. | 45 sec | 215 ml | 4 l |

-continued

Processing steps

| Step | Temperature | Time | Replenisher Tank Amount* | Replenisher Tank Volume |
|---|---|---|---|---|
| Stabilizing ① | 30–37° C. | 20 sec | — | 2 l |
| Stabilizing ② | 30–37° C. | 20 sec | — | 2 l |
| Stabilizing ③ | 30–37° C. | 20 sec | 364 ml | 2 l |
| Drying | 70–85° C. | 60 sec. | | |

Note:
*Replenisher amount per 1 $m^2$ of photographic material
Stabilizing was carried out in a 3-tanks countercurrent mode from the tank of stabilizing ③ toward the tank of stabilizing ①.

The composition of the respective processing solution were as follows:

| | Tank Solution | Replenisher |
|---|---|---|
| Color developer | | |
| Water | 800 ml | 800 ml |
| Ethylenediaminetetraacetic acid | 5.0 g | 5.0 g |

-continued

| | Tank Solution | Replenisher |
|---|---|---|
| 5,6-Dihydroxybenzene-1,2,4-trisulfonate | 0.3 g | 0.3 g |
| Triethanolamine | 8.0 g | 8.0 g |
| Sodium chloride | $4.6 \times 10^{-2}$ mol | — |
| Potassium bromide | $1.3 \times 10^{-4}$ mol | — |
| Potassium carbonate | 25 g | 25 g |
| N-Ethyl-N-(β-methanesulfonamidoethyl)-3-methyl-4-aminoaniline sulfate | 5.0 g | 9.5 g |
| Organic preservative (I-1) | 0.03 mol | 0.05 mol |
| Sodium sulfite | 0.1 g | 0.2 g |
| Fluorescent brightening agent (WHITEX-4, made by Sumitomo Chemical Industries) | 1.0 g | 2.5 g |
| Water to make | 1000 ml | 1000 ml |
| pH (25° C.) | 10.05 | 10.60 |
| Bleach-fixing solution (Tank solution and replenisher are the same) | | |
| Water | 400 ml | |
| Ammonium thiosulfate (70%) | 100 ml | |
| Ammonium sulfite | 17 g | |
| Iron(III) ammonium ethylenediamine-tetraacetate dihydrate | 55 g | |
| Disodium ethylenediaminetetraacetate | 5 g | |
| Glacial acetic acid | 9 g | |
| Water to make | 1000 ml | |
| pH (25° C.) | 5.40 | |
| Stabilizing solution (Tank solution and replenisher are the same) | | |
| Formalin (37%) | 0.1 g | |
| Formalin-sulfurous acid adduct | 0.7 g | |
| 5-Chloro-2-methyl-4-isothiazoline-3-one | 0.02 g | |
| 2-Methyl-4-isothiazoline-3-one | 0.01 g | |
| Copper sulfate | 0.005 g | |
| Aqueous ammonia (28%) | 2.0 ml | |
| Water to make | 1000 ml | |
| pH (25° C.) | 4.0 | |

The continuous processing was carried out by setting up the concentration of replenisher properly in order to maintain the chloride ions and bromide ions concentrations in color developer in tank constant.

Each of the coated samples above was subjected to gradation exposure for sensitometry using a sensitometer (FWH model, made by Fuji Photo Film Co., Ltd., the color temperature of light source: 3200° K.). This exposure was made such that an exposure of 250 CMS may be secured in an exposure time of 1/10 sec.

Sensitometry was conducted at the start and the end of the running test, and the sensitivity (s), the minimum density (Dmin), and the maximum density (Dmax) of the cyan (R), the magenta (G), and the yellow (B) at the start and the end of the running were measured. The sensitivity was read out at a point of density of 1.0, and the maximum density and the minimum density were expressed by the deviation at the end of the running from the start of the running.

At the same time, after the above photographic material was exposed to light uniformly, so that developed silver in an amount of 90% of the coated amount of silver might be obtained, the photographic material was processed at the end of the running, and the amount of developed silver and the remaining amount of silver were measured by X-ray fluorescent analysis. Results are shown in Table 4.

At the end of the running, the above coated samples were used to evaluate sensitized streaks like Example 1. Results are shown in Table 4.

TABLE 4

| Sample | ΔDmin | | | ΔDmax | | | ΔSensitivity | | | Remaining Silver | Sensitized Streaks | Remark |
|---|---|---|---|---|---|---|---|---|---|---|---|---|
| | R | G | B | R | G | B | R | G | B | | | |
| 1-1 | 0 | −0.01 | 0 | −0.02 | −0.01 | −0.02 | 0 | −0.01 | −0.01 | 0.8 | ○ | This Invention |
| 2-1 | 0 | 0 | 0 | +0.01 | 0 | −0.01 | −0.01 | −0.01 | 0 | 0.9 | ○ | " |
| 2-2 | +0.02 | 0 | −0.01 | −0.25 | −0.02 | −0.03 | −0.20 | −0.03 | −0.01 | 2.5 | ○ | Comparative Example |
| 2-3 | 0 | 0 | 0 | +0.01 | −0.02 | −0.01 | 0 | −0.01 | −0.02 | 1.0 | ○ | This Invention |
| 2-4 | −0.01 | +0.02 | −0.01 | −0.02 | −0.19 | −0.02 | −0.01 | −0.25 | −0.02 | 3.1 | ○ | Comparative Example |
| 2-5 | 0 | 0 | −0.01 | +0.01 | −0.01 | +0.01 | −0.02 | −0.01 | −0.02 | 0.7 | ○ | This Invention |
| 2-6 | 0 | 0 | +0.03 | −0.01 | −0.02 | −0.35 | 0 | −0.01 | −0.31 | 3.8 | ○ | Comparative Example |

As is apparent from the results in Table 4, samples containing in the blue-sensitive emulsion layer, the green-sensitive emulsion layer, and the red-sensitive emulsion layer couplers having relative coupling rate in the range of the present invention, respectively, are small in fluctuation of photographic property (in particular, sensitivity) and good in desilvering and pressure-sensitized streaks.

EXAMPLE 3

Samples 3-1 to 3-4 were prepared by repeating the procedure as Sample 1-1 in Example 1, except that the coating amount of each emulsion layer was changed as shown in Table 5.

TABLE 5

| Sample | Coating Amount of Silver ($g/m^2$) B | G | R | Total |
|---|---|---|---|---|
| 1-1 | 0.30 | 0.12 | 0.23 | 0.65 |
| 3-1 | 0.33 | 0.15 | 0.27 | 0.75 |
| 3-2 | 0.35 | 0.17 | 0.28 | 0.80 |
| 3-3 | 0.37 | 0.19 | 0.30 | 0.86 |
| 3-4 | 0.39 | 0.24 | 0.33 | 0.96 |

The above Samples 1-1 and 3-1 to 3-4 were subjected to an exposure to light image-wise and to a continuous processing (running test) according to the following processing steps and the processing solutions having given composition by a color paper-processor until the replenishing amount of color developer reached 2-times as much as tank volume.

| Processing Steps | Temperature | Time | Replenisher Tank Amount* | Volume |
|---|---|---|---|---|
| Color Development | 38° C. | 45 sec | 100 ml | 4 l |
| Bleach-fixing | 30–36° C. | 45 sec | 61 ml | 4 l |
| Water washing (1) | 30–37° C. | 30 sec | — | 2 l |
| Water washing (2) | 30–37° C. | 30 sec | — | 2 l |
| Water washing (3) | 30–37° C. | 30 sec | 364 ml | 2 l |
| Drying | 70–85° C. | 60 sec. | | |

Note:
*Replenisher amount per 1 $m^2$ of photographic material
Washing was carried out in a 3-tanks countercurrent mode from the tank of washing (3) toward the tank of washing (1). Water washing (1) solution of 122 $ml/m^2$ of photographic material was replenished to bleach-fixing.

The composition of the respective processing solution were as follows:

| | Tank Solution | Replenisher |
|---|---|---|
| Color developer | | |
| Water | 800 ml | 800 ml |
| Ethylenediamin-N,N,N',N'-tetramethylene phosphonic acid | 3.0 g | 3.0 g |
| Triethanolamine | 8.0 g | 8.0 g |
| Sodium chloride | $6.5 \times 10^{-2}$ mol | * |
| Potassium bromide | $2.2 \times 10^{-4}$ mol | * |
| Potassium carbonate | 25 g | 25 g |
| N-Ethyl-N-(β-methanesulfonamidoethyl)-3-methyl-4-aminoaniline sulfate | 5.0 g | 9.0 g |
| Organic preservative (II-19) | 0.03 mol | 0.05 mol |
| Fluorescent brightening agent (WHITEX-4, made by Sumitomo Chemical Industries) | 1.0 g | 2.5 g |
| Water to make | 1000 ml | 1000 ml |
| pH (25° C.) | 10.05 | 10.55 |
| Bleach-fixing solution | | |
| Tank solution | | |
| Water | 400 ml | |
| Ammonium thiosulfate (70%) | 100 ml | |
| Ammonium sulfite | 38 g | |
| Iron(III) ammonium ethylenediamine-tetraacetate | 55 g | |
| Disodium ethylenediaminetetraacetate | 5 g | |
| Glacial acetic acid | 9 g | |
| Water to make | 1000 ml | |
| pH (25° C.) | 5.40 | |
| Replenisher | | |
| 2.5 times concentrated tank solution | | |
| Water washing solution | | |
| (Tank solution and replenisher are the same) | | |
| Ion-exchanged water (each concentration of calcium and magnesium is 3 ppm or low) | | |

*It was set up so as to the concentration of tank solution being kept in accordance with the coating amount of silver.

The continuous processing was carried out by adding distilled water to each of color developer, bleach-fixing solution, and water washing solution in the respective evaporated amount to compensate the concentration due to evaporation.

The above coated samples were subjected to the same gradation exposure to light for sensitometry as in Example 2. And the same evaluation of photographic property as in Example 2 was carried out.

As the results, all samples showed good results, but samples having the coating amount of silver of 0.8 $g/m^2$ or less were better than the others in change of sensitivity, desilvering property and pressure-sensitized streaks.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for processing an image-wise exposed silver halide color photographic material with a color developer containing at least one aromatic primary amine colordeveloping agent, comprising processing said image-wise exposed silver halide color photographic material having at least one layer comprising a high-silver-chloride silver halide emulsion containing 80 mol % or more of silver chloride, and containing at least one coupler whose relative coupling rate is at least 0.05 in each of a red-sensitive layer, a green-sensitive layer, and a blue-sensitive layer, with a color developer containing $3.5 \times 10^{-2}$ to $1.5 \times 10^{-1}$ mol chloride ions/l and $5.0 \times 10^{-5}$ to $5.0 \times 10^{-4}$ mol bromide ions/l.

2. The method as claimed in claim 1, wherein the relative coupling rate of each coupler is in the range of 0.10 to 10.

3. The method as claimed in claim 1, wherein the content of silver chloride based on the total silver halide is at least 95 mol %.

4. The method as claimed in claim 1, wherein the total coated amount of silver of the silver halide color photographic material is at most 0.80 $g/m^2$.

5. The method as claimed in claim 1, wherein the content of chloride ions in the color developer is $4.0\times10^{-2}$ to $1.0\times10^{-1}$ mol/l.

6. The method as claimed in claim 1, wherein the color developer is substantially free of benzyl alcohol.

7. The method as claimed in claim 1, wherein the color developer contains an organic preservative.

8. The method as claimed in claim 1, wherein the processing time with the color developer is 20 seconds to 5 minutes.

9. The method as claimed in claim 1, wherein a replenishing amount of the color developer is 20 to 150 ml per square meter of the photographic material.

10. The method as claimed in claim 1, wherein the processing is by an automatic processor.

11. The method as claimed in claim 10, wherein the redsensitive layer contains a cyan coupler, the greensensitive layer contains a magenta coupler, and the blue-sensitive layer contains a yellow coupler.

12. The method as claimed in claim 1, wherein the redsensitive layer contains a cyan coupler, the greensensitive layer contains a magenta coupler, and the blue-sensitive layer contains a yellow coupler.

* * * * *